US009403368B2

(12) United States Patent
Yoshikawa et al.

(10) Patent No.: US 9,403,368 B2
(45) Date of Patent: Aug. 2, 2016

(54) PRINTING APPARATUS AND PRINTING METHOD

(71) Applicant: CANON KABUSHIKI KAISHA, Tokyo (JP)

(72) Inventors: Hirokazu Yoshikawa, Yokohama (JP); Toshiyuki Chikuma, Tokyo (JP); Satoshi Seki, Kawasaki (JP); Kenichi Oonuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/332,108

(22) Filed: Jul. 15, 2014

(65) Prior Publication Data

US 2015/0022586 A1 Jan. 22, 2015

(30) Foreign Application Priority Data

Jul. 18, 2013 (JP) ..... 2013-149874

(51) Int. Cl.
*B41J 2/165* (2006.01)

(52) U.S. Cl.
CPC .... *B41J 2/16535* (2013.01); *B41J 2002/16573* (2013.01)

(58) Field of Classification Search
CPC ..... B41J 2/5056
See application file for complete search history.

(56) References Cited

U.S. PATENT DOCUMENTS 6,017,113 A * 1/2000 Nicoloff et al. ..... 347/40
6,027,200 A * 2/2000 Takahashi et al. ..... 347/19
2003/0228046 A1* 12/2003 Inoue et al. ..... 382/141
2008/0309703 A1* 12/2008 Yamazaki ..... 347/19
2009/0015625 A1* 1/2009 Sumida ..... 347/30
2011/0134185 A1* 6/2011 Yamamoto et al. ..... 347/33

FOREIGN PATENT DOCUMENTS

| | | | |
|---|---|---|---|
| CN | 1488504 | A | 4/2004 |
| CN | 101088762 | A | 12/2007 |
| CN | 102673128 | A | 9/2012 |
| JP | 1-71758 | A | 3/1989 |
| JP | H08039833 | A | 2/1996 |
| JP | 2011079186 | A | 4/2011 |
| JP | 2012232541 | A | 11/2012 |

OTHER PUBLICATIONS

JP 2012-232541 Machine Translation: https://dossier1.j-platpat.inpitgo.jp/tri/all/odse/ODSE_GM101_Top.action.*

* cited by examiner

*Primary Examiner* — Stephen Meier
*Assistant Examiner* — John P Zimmermann
(74) *Attorney, Agent, or Firm* — Canon U.S.A., Inc. IP Division

(57) ABSTRACT

In a case in which a cumulative value ΣNure of wetting coefficients is less than a wetting threshold value THNure, printing is carried out on a unit area through a print mode in which an image is completed through a first number of instances of a scan, and in a case in which the cumulative value ΣNure is equal to or greater than the wetting threshold value THNure, printing is carried out on a unit area through a print mode in which an image is completed through a second number of instances of the scan, where the second number is greater than the first number.

6 Claims, 17 Drawing Sheets

30

| PRINTING DUTY OF CYAN INK | | | | | | PRINTING DUTY OF MAGENTA INK | | | | | | PRINTING DUTY OF YELLOW INK | | | | | | |
|---|---|---|---|---|---|---|---|---|---|---|---|---|---|---|---|---|---|---|
| 0 | 0 | 3 | 0 | 0 | 0 | 0 | 0 | 0 | 0 | 0 | 0 | 0 | 0 | 3 | 0 | 0 | 0 | FIRST BAND |
| 0 | 0 | 1 | 0 | 0 | 0 | 0 | 0 | 64 | 64 | 0 | 0 | 0 | 0 | 65 | 64 | 0 | 0 | SECOND BAND |
| 0 | 0 | 0 | 0 | 0 | 0 | 0 | 0 | 72 | 70 | 0 | 0 | 0 | 0 | 72 | 70 | 0 | 0 | THIRD BAND |
| 0 | 0 | 0 | 0 | 0 | 0 | 0 | 0 | 0 | 0 | 0 | 0 | 0 | 0 | 0 | 0 | 0 | 0 | FOURTH BAND |
| 0 | 0 | 26 | 26 | 0 | 0 | 0 | 0 | 0 | 0 | 0 | 0 | 0 | 0 | 26 | 26 | 0 | 0 | FIFTH BAND |
| 0 | 6 | 95 | 90 | 11 | 0 | 0 | 0 | 0 | 0 | 0 | 0 | 0 | 6 | 95 | 90 | 11 | 0 | SIXTH BAND |
| 0 | 11 | 98 | 80 | 0 | 0 | 0 | 0 | 0 | 0 | 0 | 0 | 0 | 11 | 98 | 80 | 0 | 0 | SEVENTH BAND |
| 0 | 1 | 37 | 18 | 0 | 0 | 0 | 0 | 0 | 0 | 0 | 0 | 0 | 1 | 37 | 18 | 0 | 0 | EIGHTH BAND |

30

| | WETTING COEFFICIENT OF MAGENTA + YELLOW | | | | | | | | WETTING COEFFICIENT OF CYAN + YELLOW | | | | | | | | WETTING COEFFICIENT OF MAGENTA + CYAN | | | | | | | |
|---|---|---|---|---|---|---|---|---|---|---|---|---|---|---|---|---|---|---|---|---|---|---|---|---|
| FIRST BAND | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| SECOND BAND | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| THIRD BAND | 0 | 0 | 0 | 1 | 0 | 0 | 0 | 0 | 0 | 0 | 0 | 0 | 0 | 0 | 0 | 0 | 0 | 0 | 0 | 0 | 0 | 0 | 0 | 0 |
| FOURTH BAND | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| FIFTH BAND | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| SIXTH BAND | 0 | 0 | 0 | 0 | 0 | 0 | 0 | 0 | 0 | 0 | 0 | 30 | 25 | 0 | 0 | 0 | 0 | 0 | 0 | 0 | 0 | 0 | 0 | 0 |
| SEVENTH BAND | 0 | 0 | 0 | 0 | 0 | 0 | 0 | 0 | 0 | 0 | 0 | 30 | 20 | 0 | 0 | 0 | 0 | 0 | 0 | 0 | 0 | 0 | 0 | 0 |
| EIGHTH BAND | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

MAXIMUM WETTING COEFFICIENT VALUE
IN EACH DETERMINATION AREA

| | | | | | | | | |
|---|---|---|---|---|---|---|---|---|
| ΣNure = 0 | Total Nure = 0 | 0 | 0 | 0 | 0 | 0 | 0 | FIRST BAND |
| ΣNure = 0 | Total Nure = 0 | 0 | 0 | 0 | 0 | 0 | 0 | SECOND BAND |
| ΣNure = 1 | Total Nure = 1 | 0 | 0 | 1 | 0 | 0 | 0 | THIRD BAND |
| ΣNure = 1 | Total Nure = 0 | 0 | 0 | 0 | 0 | 0 | 0 | FOURTH BAND |
| ΣNure = 1 | Total Nure = 0 | 0 | 0 | 0 | 0 | 0 | 0 | FIFTH BAND |
| ΣNure = 56 | Total Nure = 55 | 0 | 0 | 30 | 25 | 0 | 0 | SIXTH BAND |
| ΣNure = 106 | Total Nure = 50 | 0 | 0 | 30 | 20 | 0 | 0 | SEVENTH BAND |
| ΣNure = 106 | Total Nure = 0 | 0 | 0 | 0 | 0 | 0 | 0 | EIGHTH BAND |

FIG. 8A

| MAGENTA + YELLOW | | PRINTING DUTY OF MAGENTA INK | | | | | | | | | |
|---|---|---|---|---|---|---|---|---|---|---|---|
| | | ≤ 10% | ≤ 20% | ≤ 30% | ≤ 40% | ≤ 50% | ≤ 60% | ≤ 70% | ≤ 80% | ≤ 90% | ≤ 100% |
| PRINTING DUTY OF YELLOW INK | ≤ 10% | 0 | 0 | 0 | 0 | 0 | 0 | 0 | 0 | 0 | 0 |
| | ≤ 20% | 0 | 0 | 0 | 0 | 0 | 0 | 0 | 0 | 0 | 0 |
| | ≤ 30% | 0 | 0 | 0 | 0 | 0 | 0 | 0 | 0 | 0 | 0 |
| | ≤ 40% | 0 | 0 | 0 | 0 | 0 | 0 | 0 | 0 | 0 | 0 |
| | ≤ 50% | 0 | 0 | 0 | 0 | 0 | 0 | 0 | 0 | 0 | 0 |
| | ≤ 60% | 0 | 0 | 0 | 0 | 0 | 0 | 0 | 0 | 0 | 0 |
| | ≤ 70% | 0 | 0 | 0 | 0 | 0 | 0 | 0 | 0 | 0 | 0 |
| | ≤ 80% | 0 | 0 | 0 | 0 | 0 | 0 | 0 | 1 | 1 | 1 |
| | ≤ 90% | 0 | 0 | 0 | 0 | 0 | 0 | 0 | 1 | 1 | 1 |
| | ≤ 100% | 0 | 0 | 0 | 0 | 0 | 0 | 0 | 1 | 1 | 1 |

FIG. 8B

| CYAN + YELLOW | | PRINTING DUTY OF CYAN INK | | | | | | | | | |
|---|---|---|---|---|---|---|---|---|---|---|---|
| | | ≤ 10% | ≤ 20% | ≤ 30% | ≤ 40% | ≤ 50% | ≤ 60% | ≤ 70% | ≤ 80% | ≤ 90% | ≤ 100% |
| PRINTING DUTY OF YELLOW INK | ≤ 10% | 0 | 0 | 0 | 0 | 0 | 0 | 0 | 0 | 0 | 0 |
| | ≤ 20% | 0 | 0 | 0 | 0 | 0 | 0 | 0 | 1 | 1 | 1 |
| | ≤ 30% | 0 | 0 | 0 | 0 | 0 | 0 | 1 | 4 | 4 | 4 |
| | ≤ 40% | 0 | 0 | 0 | 0 | 0 | 1 | 4 | 6 | 6 | 6 |
| | ≤ 50% | 0 | 0 | 0 | 0 | 1 | 4 | 6 | 8 | 8 | 8 |
| | ≤ 60% | 0 | 0 | 0 | 1 | 4 | 6 | 8 | 10 | 10 | 10 |
| | ≤ 70% | 0 | 0 | 1 | 4 | 6 | 8 | 10 | 15 | 15 | 15 |
| | ≤ 80% | 0 | 1 | 4 | 6 | 8 | 10 | 15 | 20 | 20 | 20 |
| | ≤ 90% | 0 | 1 | 4 | 6 | 8 | 10 | 15 | 20 | 25 | 25 |
| | ≤ 100% | 0 | 1 | 4 | 6 | 8 | 10 | 15 | 20 | 25 | 30 |

FIG. 8C

| CYAN + MAGENTA | | PRINTING DUTY OF CYAN INK | | | | | | | | | |
|---|---|---|---|---|---|---|---|---|---|---|---|
| | | ≤ 10% | ≤ 20% | ≤ 30% | ≤ 40% | ≤ 50% | ≤ 60% | ≤ 70% | ≤ 80% | ≤ 90% | ≤ 100% |
| PRINTING DUTY OF MAGENTA INK | ≤ 10% | 0 | 0 | 0 | 0 | 0 | 0 | 0 | 0 | 0 | 0 |
| | ≤ 20% | 0 | 0 | 0 | 0 | 0 | 0 | 0 | 0 | 0 | 0 |
| | ≤ 30% | 0 | 0 | 0 | 0 | 0 | 0 | 0 | 0 | 0 | 0 |
| | ≤ 40% | 0 | 0 | 0 | 0 | 0 | 0 | 0 | 0 | 0 | 0 |
| | ≤ 50% | 0 | 0 | 0 | 0 | 0 | 1 | 1 | 1 | 1 | 1 |
| | ≤ 60% | 0 | 0 | 0 | 0 | 1 | 2 | 2 | 2 | 4 | 4 |
| | ≤ 70% | 0 | 0 | 0 | 0 | 1 | 2 | 2 | 4 | 6 | 6 |
| | ≤ 80% | 0 | 0 | 0 | 0 | 1 | 2 | 4 | 6 | 7 | 7 |
| | ≤ 90% | 0 | 0 | 0 | 0 | 1 | 4 | 6 | 7 | 7 | 8 |
| | ≤ 100% | 0 | 0 | 0 | 0 | 1 | 4 | 6 | 7 | 8 | 8 |

PRINTING APPARATUS AND PRINTING METHOD

BACKGROUND OF THE INVENTION

1. Field of the Invention

The present invention relates to printing apparatuses and printing methods.

2. Description of the Related Art

To date, image printing apparatuses are known which form an image on a print medium by ejecting ink to the print medium while moving a print head having a plurality of nozzles for ejecting ink arrayed therein relative to the print medium. In such image printing apparatuses, a so-called multipass method is employed through which a unit area of the print medium is scanned a plurality of times.

In such printing apparatuses, in a case in which the frequency at which ink is ejected is high, the following phenomenon is known to occur. Ink ejected through the nozzles drags in the air around the surface of the nozzles when moving toward the print medium, and thus the vicinity of the surface of a member in which the nozzles are formed (hereinafter, also referred to as a face) becomes depressurized. It is known that, in order to compensate for such a depressurized state, the air around the surface of the print medium moves toward the surface of the nozzles, and an air current is thus generated. Such an ascending air current toward the nozzles from the print medium tends to be greater as the amount of ink ejected at once is greater. A phenomenon in which an ink droplet generated as ejected ink splashes at the print medium or a so-called satellite ink droplet generated from a tail of ejected ink is dragged in by the ascending air current so as to travel in an opposite direction to adhere to the surface of the nozzles (hereinafter, referred to as face wetting) occurs. If ink is ejected through the nozzles after face wetting has occurred, the wet surface affects the ink at the time of ejecting the ink, and thus the ejection performance such as the direction in which the ink is ejected or the speed of the ejected ink varies. Therefore, the ink might not land on the print medium at a desired position.

Japanese Patent Laid-Open No. 1-71758 discloses a technique for suppressing a deterioration of printing quality due to face wetting, in which the number of dots formed in a unit area when the unit area is scanned by a print head is obtained and the surface of the nozzles is wiped on the basis of the obtained number of dots. According to the disclosed technique, the surface of the nozzles is wiped in a case in which the obtained number of dots exceeds a first value, and the surface of the nozzles is also wiped in a case in which a cumulative number of dots formed through scans spanning from a scan carried out immediately after the last time the surface is wiped to a scan to be carried out on a given unit area exceeds a second value.

However, according to the technique disclosed in Japanese Patent Laid-Open No. 1-71758, the face is wiped to remove the ink that has adhered to the face each time it is detected that face wetting has occurred at a notable level, and thus it takes a long time to completely form an image on the print medium. For example, in a case in which an image that is completely formed by ejecting ink on substantially the entire area of a single sheet of the print medium (hereinafter, referred to as a solid image) is to be printed, it is speculated that face wetting occurs fairly frequently, and thus an influence on the throughput of printing increases.

SUMMARY OF THE INVENTION

The present invention has been made in view of the above-described problem, and the present invention is directed to providing a printing apparatus and a printing method that can suppress a deterioration of printing quality caused by face wetting and also suppress a decrease in the throughput.

According to an aspect of the present invention, a printing apparatus prints an image on a plurality of unit areas of a print medium by ejecting ink from a print head having at least one nozzle array in which a plurality of nozzles for ejecting ink are arrayed in an array direction while scanning the print head in a scan direction crossing the array direction, and each of the plurality of unit areas has a length in the array direction corresponding to a length of the nozzle array in the array direction. The printing apparatus includes a selecting unit configured to select either a first print mode or a second print mode with respect to each of the plurality of unit areas. The first print mode is a print mode for printing an image on the unit area by scanning the print head a first number of times, and the second print mode is a print mode for printing an image on the unit area by scanning of the print head a second number, which is greater than the first number, of times while a number of the nozzles ejecting ink each time the print head is scanned the second number of times is restricted. The printing apparatus further includes a wiping unit configured to wipe a surface of a nozzle member provided with the plurality of nozzles, an obtaining unit configured to obtain first information regarding a sum of ink ejection amounts in scans between a scan that is performed immediately after the surface of the nozzle member is wiped by the wiping unit and another scan in which ink is ejected to one of the unit areas, and a controlling unit configured to control printing according to either the first print mode or the second print mode selected by the selecting unit. In the printing apparatus, the selecting unit selects (i) the first print mode in a case in which a value indicated by the first information obtained by the obtaining unit is a first value, and (ii) the second print mode in a case in which the value indicated by the first information obtained by the obtaining unit is a second value that is greater than the first value.

Further features of the present invention will become apparent from the following description of exemplary embodiments with reference to the attached drawings.

BRIEF DESCRIPTION OF THE DRAWINGS

FIGS. 8A to 8C are tables to be used to calculate the wetting coefficient according to the exemplary embodiment.

DESCRIPTION OF THE EMBODIMENTS

First Exemplary Embodiment

Hereinafter, a first exemplary embodiment of the present invention will be described in detail with reference to the drawings.

Figure 1:
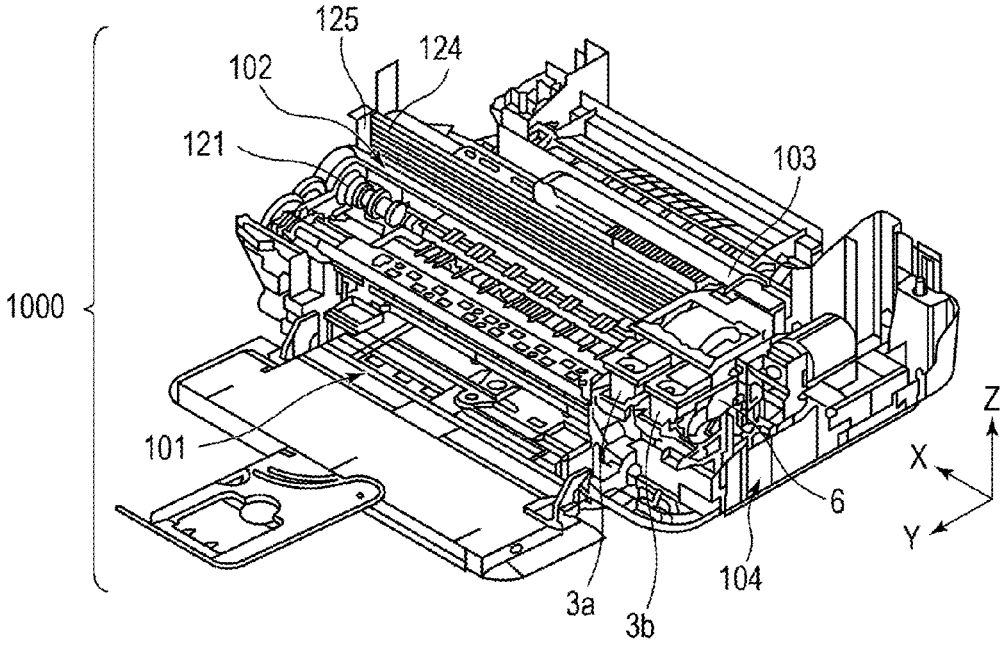
FIG. 1 is a perspective view of an image printing apparatus according to an exemplary embodiment.

FIG. 1 is a perspective view illustrating an internal configuration of part of a printing apparatus 1000 according to the first exemplary embodiment of the present invention.

As illustrated in FIG. 1, the printing apparatus 1000 includes a sheet feeding unit 101, a conveying unit 102, a printing unit 103, and a recovery unit 104. The sheet feeding unit 101 feeds a print medium into the printing apparatus 1000. The conveying unit 102 conveys the print medium, fed by the sheet feeding unit 101, in a Y direction (conveying direction). The printing unit 103 prints an image on the print medium in accordance with image information. The recovery unit 104 carries out a recovery operation so as to maintain the ink ejection performance of a print head to thus maintain the quality of images to be printed.

The sheet feeding unit 101 feeds a print medium into the printing apparatus 1000. The print media stacked on the sheet feeding unit 101 are separated by a sheet feeding roller (not illustrated) driven by a sheet feeding motor (not illustrated) and are fed, one by one, to the conveying unit 102.

The conveying unit 102 conveys the print medium fed by the sheet feeding unit 101. The print medium fed to the conveying unit 102 is pinched by a conveying roller 121, driven by a conveying motor (not illustrated) and a pinching roller (not illustrated), and is conveyed through the printing unit 103.

The printing unit 103 ejects ink on the print medium through the print head, which will be described later, in accordance with image data to thus print an image. The printing unit 103 includes a carriage 6, which can reciprocate in an X direction (scan direction) crossing the Y direction, and print cartridges 3*a* and 3*b*, which will be described later, mounted in the carriage 6.

The carriage 6 is supported so as to be capable of reciprocating in the X direction along a guide rail disposed in the printing apparatus 1000. The carriage 6, when printing on the print medium, reciprocates over a print area along with a carriage belt 124 driven by a carriage motor (not illustrated). The position and the speed of the carriage 6 are detected by an encoder sensor (not illustrated) mounted on the carriage 6 and an encoder scale 125 that extends in the printing apparatus 1000, and the movement of the carriage 6 is controlled in accordance with the detected position and speed. Ink is ejected from the print cartridges 3*a* and 3*b* while the carriage 6 is moved, and thus the print medium can be printed. The print medium printed by the printing unit 103 is pinched by a discharging roller (not illustrated) driven synchronously with the conveying roller 121 by the conveying unit 102 and a spurring roller (not illustrated) pressurized by the discharging roller and is then discharged to the outside of the printing apparatus 1000.

The recovery unit 104 wipes ink droplets that have adhered to the surface of the nozzles so as to restore the surface of the nozzles to a normal state. The recovery unit 104 includes a capping mechanism, which will be described later, for covering the nozzles after printing is carried out, and a wiping mechanism, which will be described later, for wiping the surface of the nozzles. The recovery unit 104 further includes a slider 7 (see FIG. 4) capable of sliding within a predetermined area so as to follow the movement of the carriage 6 while the carriage 6 is moving toward the recovery unit 104.

Figure 2A:
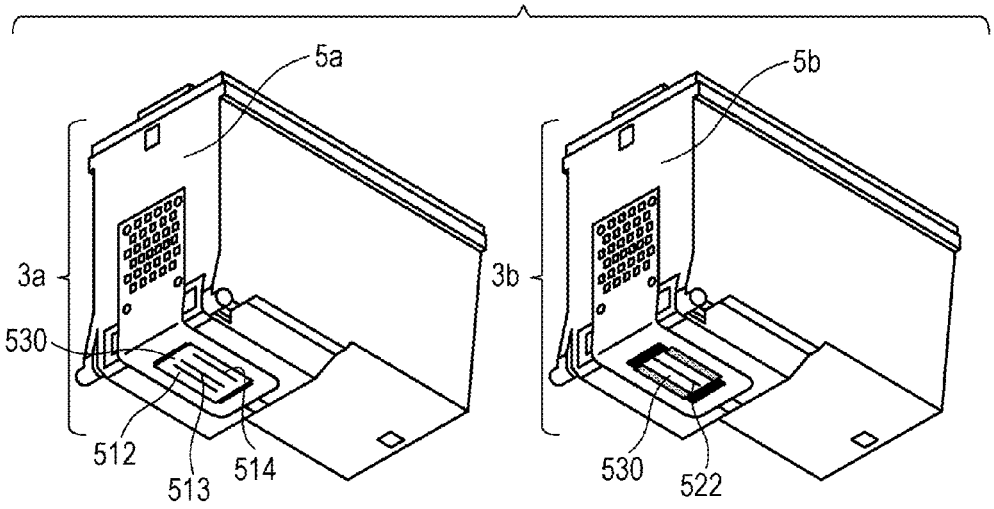
FIGS. 2A and 2B are perspective views of a printing unit according to the exemplary embodiment.

FIG. 2A is a diagram for describing, in detail, the print cartridges 3*a* and 3*b* according to the present exemplary embodiment. The print cartridge 3*a* includes a print head 5*a*, which is part of a print head 5, for ejecting chromatic color inks, namely, a cyan ink, a magenta ink, and a yellow ink. The print cartridge 3*a* includes three ink tanks (not illustrated) for storing the respective chromatic color inks, and the print head 5*a* that is formed integrally with the ink tanks and serves to eject the inks supplied from the ink tanks. Meanwhile, the print cartridge 3*b* includes a print head 5*b*, which is part of the print head 5, for ejecting a black ink. The print cartridge 3*b* includes an ink tank (not illustrated) for storing the black ink, and the print head 5*b*, which will be described later, that is formed integrally with the ink tank and serves to eject the ink supplied from the ink tank. The print head 5*a* includes a nozzle array 512 for ejecting a cyan ink, a nozzle array 513 for ejecting a magenta ink, and a nozzle array 514 for ejecting a yellow ink; and the print head 5*b* includes a nozzle array 522 for ejecting a black ink. The nozzle arrays 512, 513, 514, and 522 are provided in the surface of nozzle members 530. The nozzle arrays 512 to 514 for the chromatic color inks may be formed in a common nozzle member 530 or may be formed separately in separate nozzle members 530.

Figure 2B:
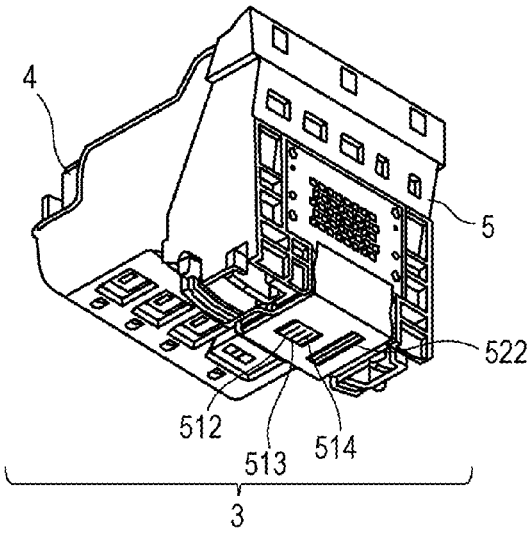

Although a mode in which the print cartridge 3*a* for the chromatic color inks and the print cartridge 3*b* for the black ink, as illustrated in FIG. 2A, are used has been described in the present exemplary embodiment, the present exemplary embodiment may employ a different mode. For example, a print cartridge 3 that includes the print head 5 may instead be used, and the print head 5 may include the nozzle array 512 for the cyan ink, the nozzle array 513 for the magenta ink, the nozzle array 514 for the yellow ink, and the nozzle array 522 for the black ink, as illustrated in FIG. 2B. In the print cartridge 3, ink tanks 4 for the respective colors are provided so as to be removable from the print head 5 and can thus be replaced.

Figure 3:
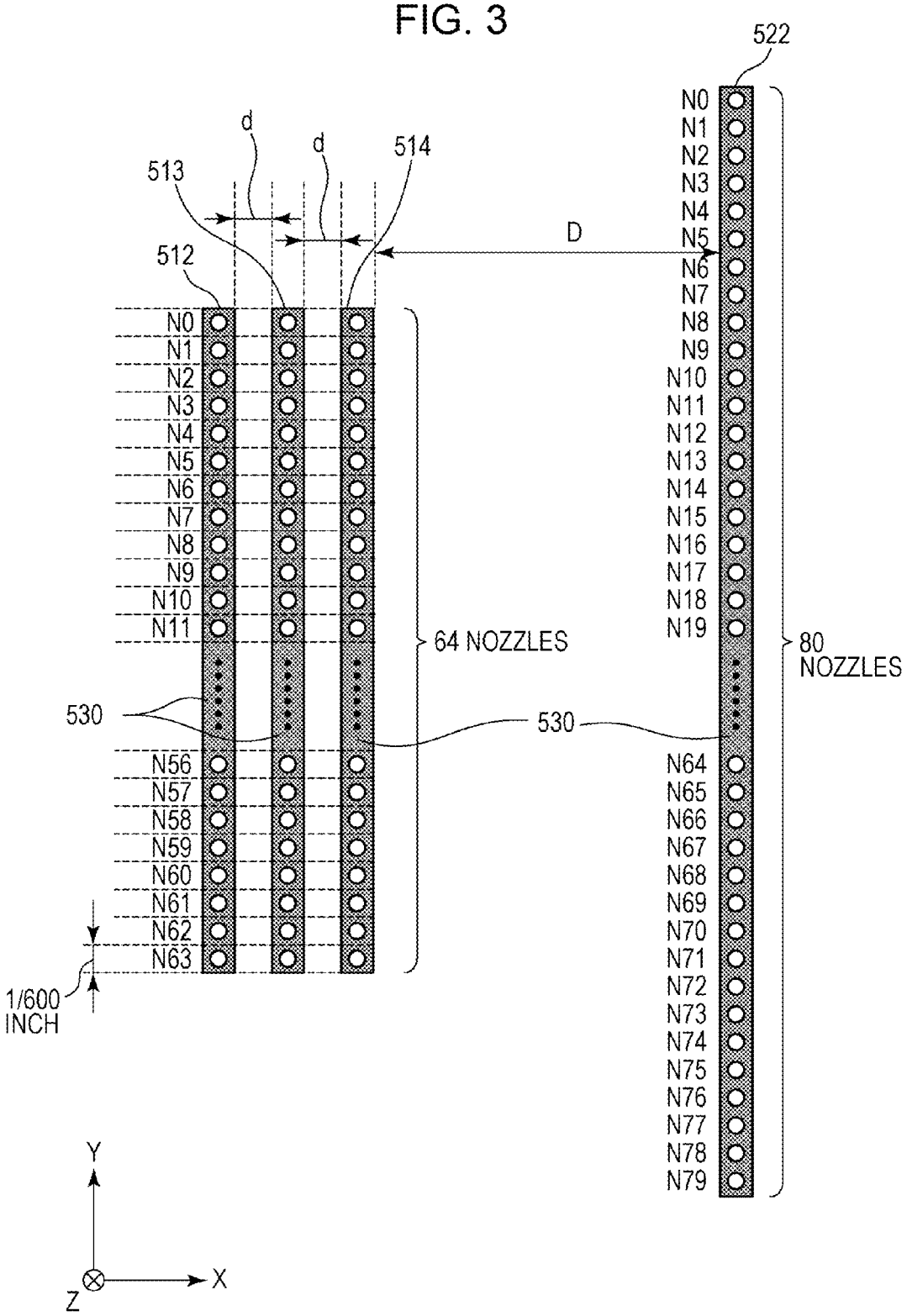
FIG. 3 is a schematic diagram of a print head according to the exemplary embodiment.

FIG. 3 is a diagram for describing, in detail, a surface of the print head 5 at which the nozzle face is provided according to the present exemplary embodiment.

The nozzle array 512 for the cyan ink, the nozzle array 513 for the magenta ink, and the nozzle array 514 for the yellow ink each include 64 nozzles, namely, a nozzle N0 to a nozzle N63, formed in the surface of the nozzle member 530, and the 64 nozzles are arrayed in the Y direction (predetermined direction) at a density of 600 nozzles per inch (i.e., 600 dpi). Meanwhile, the nozzle array 522 for ejecting the black ink includes 80 nozzles, namely, a nozzle N0 to a nozzle N79, formed in the surface of the nozzle member 530, and the 80 nozzles are arrayed in the Y direction at a density of 600 dpi. It should be noted that "the surface of the nozzles" as used in the present exemplary embodiment refers substantially to the surface of the nozzle member 530. The nozzle array 512 for the cyan ink, the nozzle array 513 for the magenta ink, and the nozzle array 514 for the yellow ink are disposed in the X direction with a distance d provided between mutually adjacent nozzle arrays among the nozzle arrays 512, 513, and 514. Meanwhile, the nozzle array 522 for the black ink is disposed so as to be spaced apart from the nozzle array 514 for the yellow ink by a distance D, which is greater than the distance d, in the X direction with the center of the nozzle array 522 in the Y direction being flush with the center of the nozzle array 514 for the yellow ink in the Y direction along the X direction.

Figure 4:
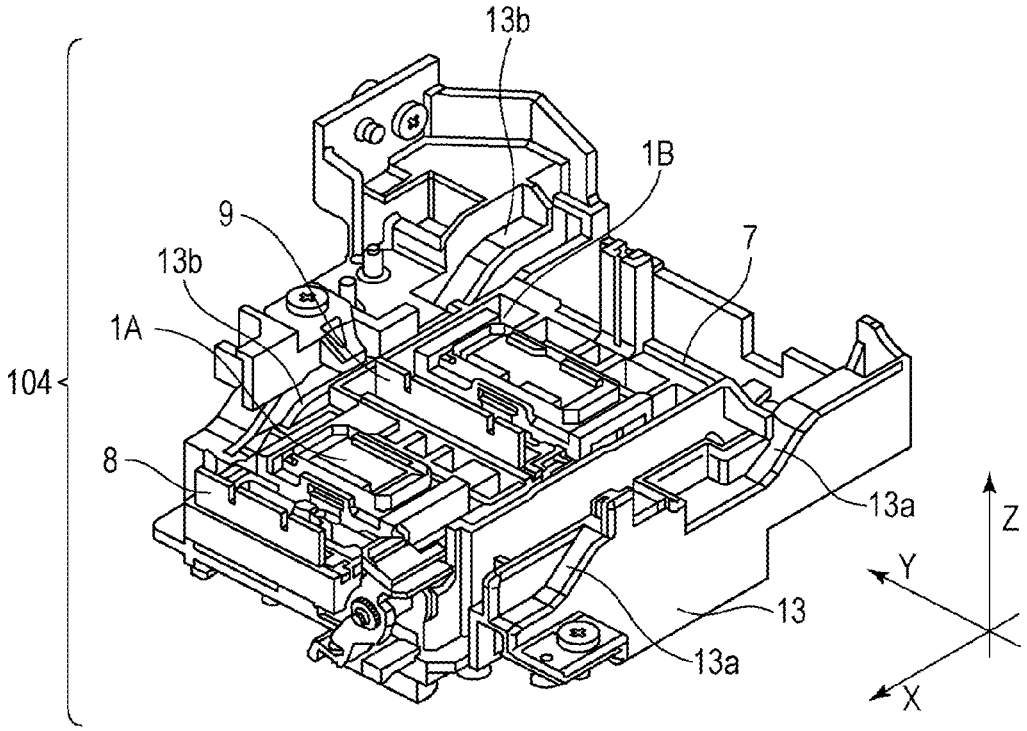
FIG. 4 is a perspective view of a recovery unit according to the exemplary embodiment.

FIG. 4 is a diagram for describing, in detail, the recovery unit 104 according to the present exemplary embodiment.

The slider 7 serving as a wiper holder includes caps 1A and 1B. The cap 1A is configured to cover the nozzles arrayed in the nozzle arrays 512, 513, and 514; and the cap 1B is configured to cover the nozzles arrayed in the nozzle array 522. In addition, wipers 8 and 9 are provided in the slider 7. The wiper 8 is configured to wipe the surface of the nozzles arrayed in the nozzle arrays 512, 513, and 514; and the wiper 9 is configured to wipe the surface of the nozzles arrayed in the nozzle array 522.

Upon the recovery unit 104 being moved through the slider 7 to a wiping position at which the wipers 8 and 9 can wipe the surface of the nozzle member 530 (the surface of the nozzles), the recovery unit 104 is moved in the X direction relative to the printing unit 103 so as to wipe the surface of the nozzles while allowing the wipers 8 and 9 to make contact with the surface of the nozzles.

The slider 7 is capable of moving in a Z direction between the aforementioned wiping position and a wiper standby position at which the wipers 8 and 9 are spaced apart from the print head 5. The slider 7 is also capable of moving in a predetermined area so as to follow the movement of the carriage 6 while the carriage 6 moves toward the recovery unit 104. The slider 7 moves along cam surfaces of slider cams 13*a* and 13*b* provided in a slider base unit 13. Through this configuration, the height of the slider 7 in the Z direction relative to the surface of the nozzles is controlled to a predetermined height at each position along the moving direction of the carriage 6.

Figure 5:
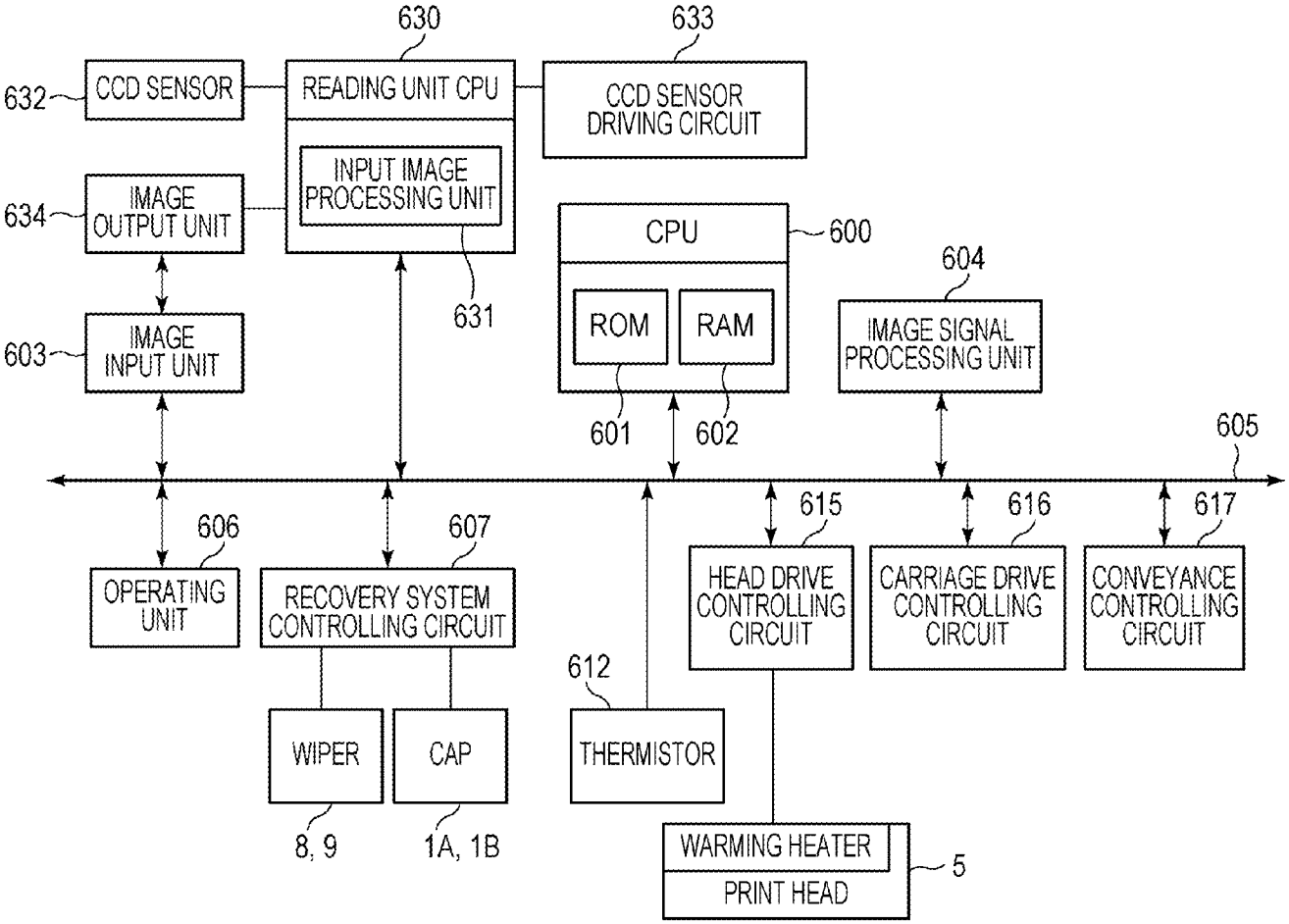
FIG. 5 is a block diagram illustrating a print controlling system according to the exemplary embodiment.

FIG. 5 is a block diagram illustrating a configuration of a print controlling system according to the present exemplary embodiment.

A central processing unit (CPU) 600 controls each of the components to be described below and carries out data processing through a main pass line 605. Specifically, the CPU 600 carries out head driving control, carriage driving control, and data processing while using the components described below in accordance with a program stored in a read only memory (ROM) 601.

A random access memory (RAM) 602 is used as a work area for the data processing and so on by the CPU 600, and a hard disk or the like may be used in place of the RAM 602 in some cases. An image input unit 603 includes an interface with a host apparatus (not illustrated), and temporarily stores an image inputted from the host apparatus. An image signal processing unit 604 carries out data processing, such as color conversion processing of converting RGB data, which is the inputted image data, to CMYK data and binarization processing of expressing the CMYK data, which has been expressed as multiple values, as binary data.

A CPU 630 for controlling a reading unit, such as a scanner, includes an input image processing unit 631, and is connected to a CCD sensor 632, a CCD sensor driving unit 633, an image output unit 634, and the main pass line 605. The CCD sensor driving unit 633 controls input driving of the CCD sensor 632. The input image processing unit 631 subjects a signal from the CCD sensor 632 to processing such as A/D conversion and shading correction. The image processed in the input image processing unit 631 is transmitted to the image input unit 603 through the image output unit 634.

An operating unit 606 includes a start key and so on, which allows a user to carry out control. A recovery system controlling circuit 607 controls a recovery operation, such as auxiliary ejection, in accordance with a recovery processing program stored in the RAM 602. Specifically, the recovery system controlling circuit 607 drives the print head 5, the wipers 8 and 9, and the caps 1A and 1B.

A head drive controlling circuit 615 controls driving of an electrothermal converter provided for ejecting ink from the print head 5, and causes the print head 5 to eject ink for auxiliary ejection and printing. A carriage drive controlling circuit 616 and a conveyance controlling circuit 617 control the movement of the carriage 6 and the conveyance of the print medium, respectively, in accordance with programs.

A warming heater is provided on a substrate on which the electrothermal converter for ejecting ink from the print head 5 is provided, and the ink inside the print head 5 can be heated to a desired temperature. A thermistor 612 is also provided on the stated substrate so as to measure the temperature of the ink inside the print head 5. The thermistor 612 does not need to be provided on the substrate but may be provided outside the print head 5, such as in the vicinity of the print head 5.

Figure 6:
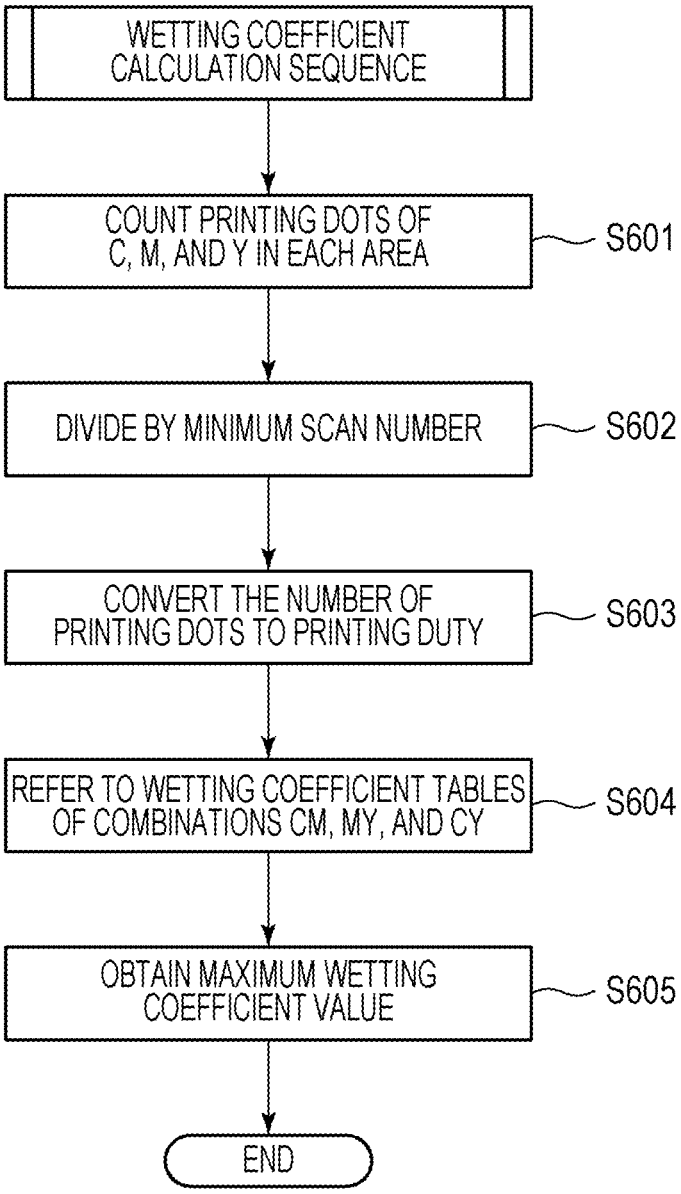
FIG. 6 is a flowchart illustrating a wetting coefficient calculation sequence according to the exemplary embodiment.

FIG. 6 is a flowchart for describing a method for calculating a wetting coefficient that indicates the degree of face wetting according to the present exemplary embodiment. FIGS. 7A to 7D are schematic diagrams for describing the process of calculating the wetting coefficient according to the present exemplary embodiment.

In S601, the number of printing dots of each of the cyan ink, the magenta ink, and the yellow ink is counted for each of a plurality of determination areas 30 each having a size of 40 dots at 600 dpi in the X direction by 64 dots at 600 dpi in the Y direction (dot counting). Here, since the nozzle array 522 for the black ink is spaced apart from the other nozzle arrays 512, 513, and 514, ejection of the black ink has little influence on the occurrence of the ascending air current. Therefore, the dot counting is carried out only for the cyan ink, the magenta ink, and the yellow ink in the present exemplary embodiment.

In S602, the number Q of printing dots of each of the cyan ink, the magenta ink, and the yellow ink in each of the plurality of determination areas 30 obtained in S601 is divided by a scan number N of a given print mode among print modes that can be set by the printing apparatus 1000, in which the given print mode allows a unit area to be printed at the minimum scan number. In the present exemplary embodiment, an image can be printed on the print medium through a single scan, and thus the number Q of the printing dots is divided by N=1.

Figure 7A:
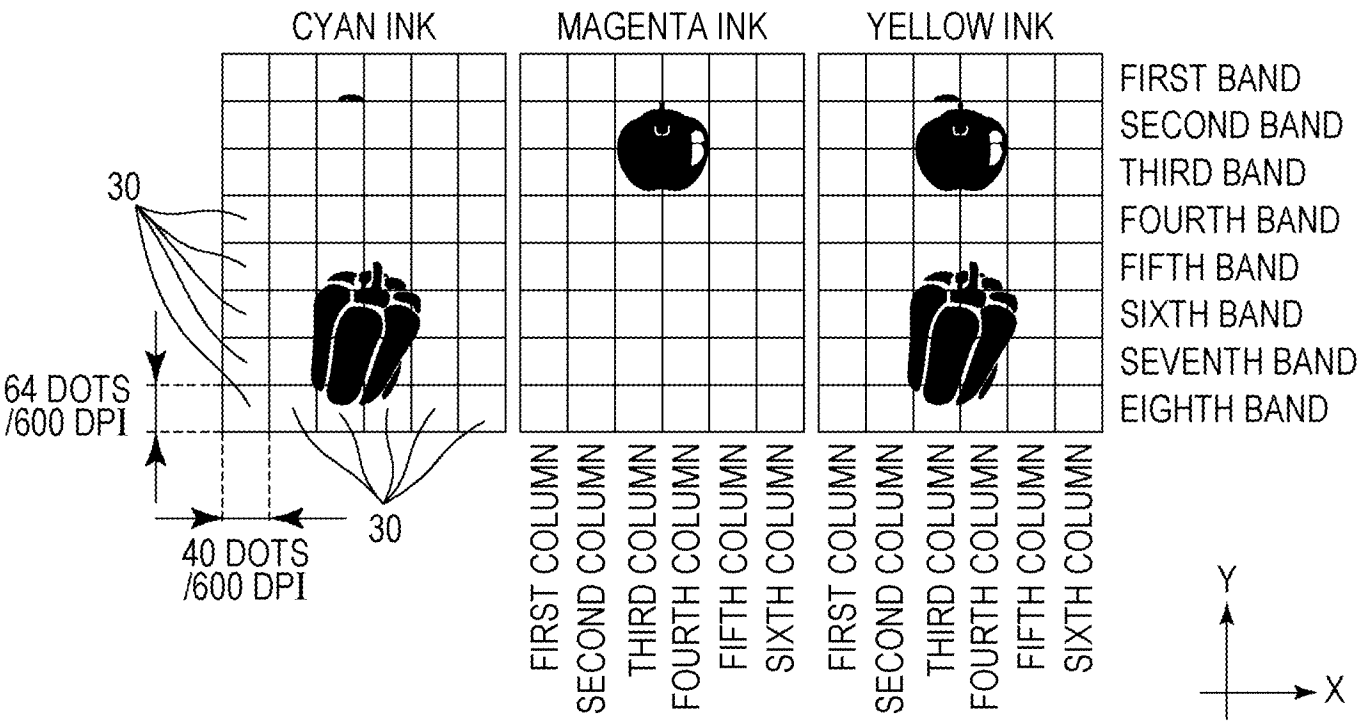
FIGS. 7A to 7D are diagrams for describing the wetting coefficient calculation sequence according to the exemplary embodiment.
Figure 7B:
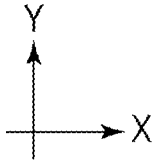

In S603, the ratio of the number of printing dots of each of the inks obtained in S602 to the maximum number of dots that can be formed by one of the inks in a single determination area 30 (hereinafter, referred to as a printing duty) is calculated. Here, the maximum number of dots that can be formed by one of the inks is 40×64. Consequently, as illustrated in FIG. 7B, the printing duty of each of the inks in each of the plurality of determination areas 30, which corresponds to the image illustrated in FIG. 7A, can be obtained. For example, with reference to FIG. 7A, a cyan ink component is at the maximum in the third and fourth columns of the sixth and seventh bands. Therefore, as illustrated in FIG. 7B, the printing duties in the third and fourth columns of the sixth and seventh bands take high values of 80% to 98%.

In S604, a wetting coefficient is calculated on the basis of two of the printing duties, obtained in S603, corresponding to two of the cyan ink, the magenta ink, and the yellow ink and a table, stored in advance in the ROM 601 of the printing apparatus 1000, indicating how likely face wetting is to occur when two of the inks are ejected, which will be described later. The wetting coefficient indicates the wettability in each of the determination areas 30, and a weighting coefficient is defined for the wettability corresponding to each of the two printing duties.

FIGS. 8A to 8C are diagrams for describing tables that are used to calculate the wetting coefficient for each of the printing duties described above and that define the weighting coefficients defined for each of the printing duties of the two inks.

FIG. 8A illustrates a table that defines the weighting coefficient that indicates how likely face wetting is to occur as the magenta ink and the yellow ink are ejected and that is defined for each of the printing duties of the magenta ink and the yellow ink. The weighting coefficient has been calculated with the intensity of the ascending air current to be generated between the ejected magenta ink and yellow ink taken into consideration. Meanwhile, FIG. 8B illustrates a table that defines the weighting coefficient that indicates how likely face wetting is to occur as the cyan ink and the yellow ink are ejected and that is defined for each of the printing duties. FIG. 8C illustrates a table that defines the weighting coefficient that indicates how likely face wetting is to occur as the cyan ink and the magenta ink are ejected and that is defined for each of the printing duties.

These wetting coefficients differ depending on parameters such as the positional relationship of the nozzle arrays ejecting the two inks, the ejection characteristics of the nozzles, and physical properties of the inks. Thus, the tables illustrated in FIGS. 8A, 8B, and 8C are preferably set as appropriate in accordance with the above-described device characteristics of the printing apparatus 1000.

In the present exemplary embodiment, it has been found through experimentation that ejection of inks from a pair of the nozzle array 512 for the cyan ink disposed at one end in the X direction and the nozzle array 514 for the yellow ink disposed at the other end in the X direction has the largest influence on occurrence of an ascending air current. Therefore, in the present exemplary embodiment, the weighting coefficient in each of the tables is set such that the weighting coefficient in the table corresponding to the cyan ink and the yellow ink illustrated in FIG. 8B is greater than the weighting coefficient in the table corresponding to the magenta ink and the yellow ink illustrated in FIG. 8A and the weighting coefficient in the table corresponding to the cyan ink and the magenta ink illustrated in FIG. 8C.

Figure 7C:
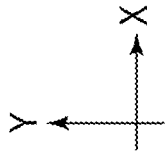

FIG. 7C illustrates the wetting coefficients calculated for the entire determination areas 30 on the basis of the printing duties illustrated in FIG. 7B and the tables illustrated in FIGS. 8A, 8B, and 8C of the weighting coefficients indicating how likely face wetting is to occur as two given inks are ejected.

For example, with reference to the printing duty illustrated in FIG. 7B, in a determination area 30 located on the fourth column of the sixth band, the printing duty of the cyan ink is 90%, and the printing duty of the yellow ink is 90%. With reference to the table illustrated in FIG. 8B, the weighting coefficient that indicates how likely face wetting is to occur as the cyan ink and the yellow ink are ejected in accordance with the stated printing duties is found to be 25. Thus, it can be determined that the wetting coefficient of the cyan ink and the yellow ink in the aforementioned determination area 30 is 25. In a similar manner, the wetting coefficient that indicates how likely face wetting is to occur as illustrated in FIG. 7C can be calculated for all of the determination areas 30 through the processing in S604.

Figure 7D:
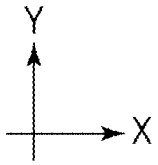

In S605, the maximum wetting coefficient among the plurality of wetting coefficients in each of the determination areas 30 obtained in S604 is selected, and this maximum wetting coefficient is obtained as a wetting coefficient XNure (second information) in each of the determination areas 30. Through this, data indicating the wetting coefficients XNure in all of the determination areas 30 as illustrated in FIG. 7D can be obtained. In addition, by calculating a sum Total_XNure of the wetting coefficients in the determination areas 30 within a single band, how likely face wetting is to occur through a scan of the stated band can be determined.

Figure 9:
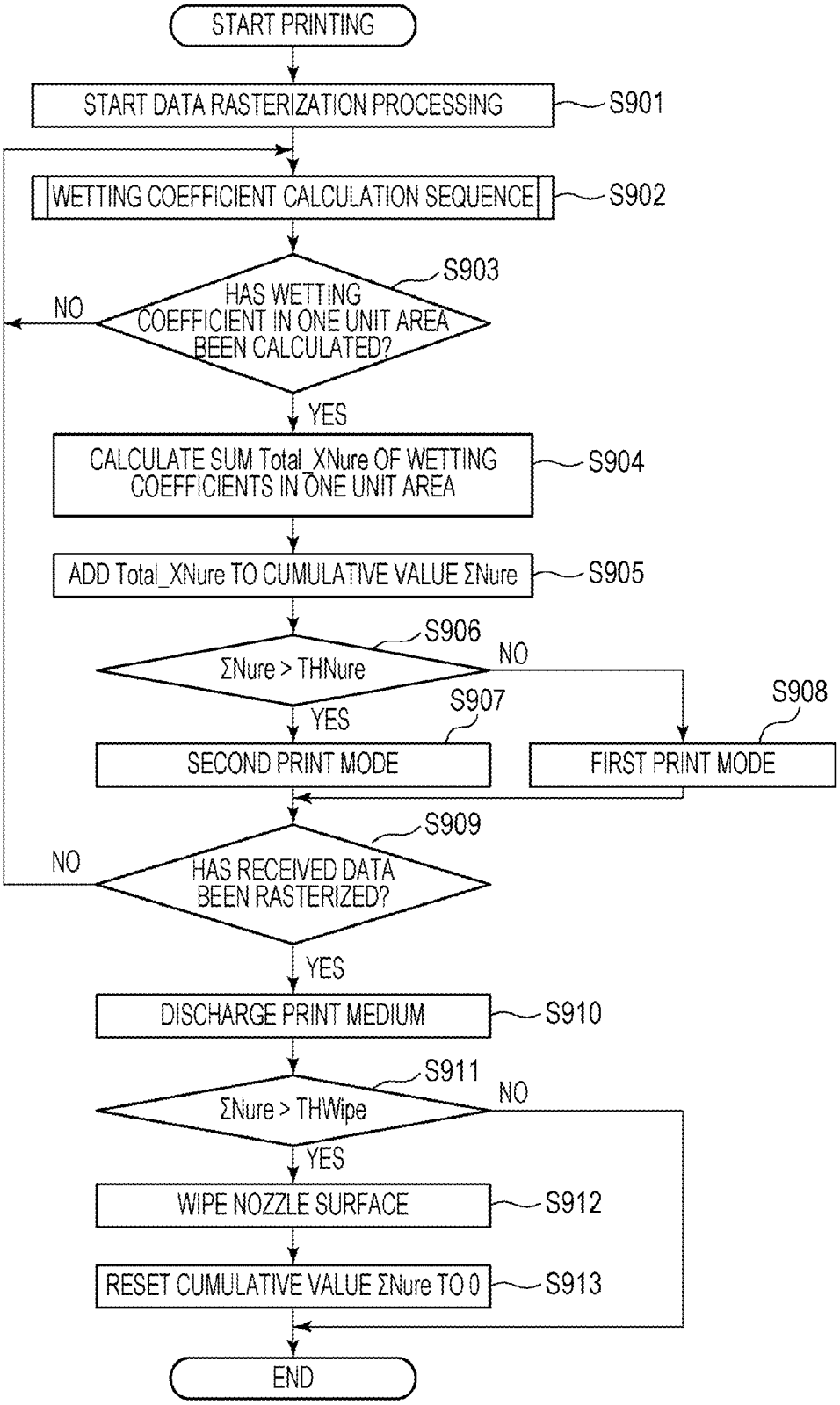
FIG. 9 is a flowchart for describing a printing method according to a first exemplary embodiment.

FIG. 9 is a flowchart for describing a printing method according to the present exemplary embodiment.

In S901, binary data is obtained through binarization for each of the inks, and in S902, the wetting coefficient calculation sequence described above is carried out.

In 5903, it is determined whether or not the wetting coefficients XNure in the plurality of determination areas 30 within a single unit area to be scanned have been calculated. Here, a unit area corresponds to an area on the print medium that can be printed through a scan performed by the print head 5. The length of the unit area in the X direction corresponds to the entire width of the print medium, and the length in the Y direction corresponds to the length of the nozzle arrays. In the present exemplary embodiment, the unit area has a size of 240 dots at 600 dpi in the X direction by 64 dots at 600 dpi in the Y direction. It should be noted that a single unit area includes six determination areas 30. Hereinafter, an image formed within a unit area may be referred to as a band in some cases. If it is determined that the wetting coefficients XNure have been calculated, the processing proceeds to S904.

In S904, as illustrated in FIG. 7D, the sum Total_XNure of the wetting coefficients XNure in the plurality of determination areas 30 within the single unit area is calculated. Thereafter, the processing proceeds to S905.

In S905, the obtained sum Total_XNure corresponding to the scan of the single unit area is added to a cumulative value of the sum Total_XNure of the scans from a scan carried out immediately after the last time the surface of the nozzles has been wiped so as to obtain a cumulative value ΣNure (first information). Thereafter, the processing proceeds to S906.

In S906, it is determined whether or not the cumulative value ΣNure calculated in S905 is less than a wetting threshold value THNure. Here, the wetting threshold value THNure corresponds to a value at which it is estimated that the ejection performance of the nozzles deteriorates notably if any additional ink droplet adheres to the surface of the nozzles. The wetting threshold value THNure can be set to an appropriate value in accordance with the physical properties of the nozzles and the inks. In the present exemplary embodiment, the wetting threshold value THNure is set to 100.

If the cumulative value ΣNure is less than the wetting threshold value THNure, the processing proceeds to S908. In S908, a first print mode, which will be described later, is set for the scan of the single unit area, and printing is then carried out. Meanwhile, if the cumulative value ΣNure is equal to or greater than the wetting threshold value THNure, the processing proceeds to S907. In S907, a second print mode, which will be described later, is set for the scan of the single unit area and printing is then carried out. After the processing in either of S907 and S908 is carried out, the processing proceeds to S909.

In S909, it is determined whether or not all of the received print data has been rasterized. If it is determined that not all of the received print data has been rasterized, the processing returns to S902, and in S902, the wetting coefficient XNure of a unit area corresponding to a subsequent scan is calculated. If it is determined that all of the received print data has been rasterized, it is determined that printing on a single sheet of the print medium has been completed. The processing then proceeds to S910, and in S910, the print medium is discharged.

After the print medium has been discharged, in S911, it is determined whether or not the cumulative value ΣNure is less than a wiping threshold value THWipe. Here, the wiping threshold value THWipe corresponds to a value for estimating as to whether or not face wetting occurs to such an extent that the ejection performance deteriorates notably due to face wetting when printing is carried out on a subsequent sheet of the print medium. As in the wetting threshold value THNure, the wiping threshold value THWipe can be set to an appropriate value in accordance with the physical properties of the nozzles and the inks. In the present exemplary embodiment, the wiping threshold value THWipe is set to 90.

If the cumulative value ΣNure is less than the wiping threshold value THWipe, it is determined that the possibility of a deterioration of the ejection performance occurring due to face wetting is low when a subsequent sheet of the print medium is printed, and the printing is thus terminated.

Meanwhile, if the cumulative value ΣNure is greater than the wiping threshold value THWipe, the processing proceeds to S912, and in S912, the surface of the nozzles is wiped by the wipers 8 and 9. Thereafter, the processing proceeds to S913. In S913, the cumulative value ΣNure is initialized to ΣNure=0, and the printing is then terminated.

In the present exemplary embodiment, as illustrated in FIG. 7D, the cumulative value ΣNure is 106 when all of the received data has been rasterized, and the cumulative value ΣNure is thus greater than the wiping threshold value THWipe of 90. Therefore, the surface of the nozzles is wiped by the wipers 8 and 9 after the print medium is discharged. The stored cumulative value ΣNure is then initialized to ΣNure=0, and the printing is terminated.

Hereinafter, the first print mode and the second print mode mentioned above will be described in detail.

Figure 10:
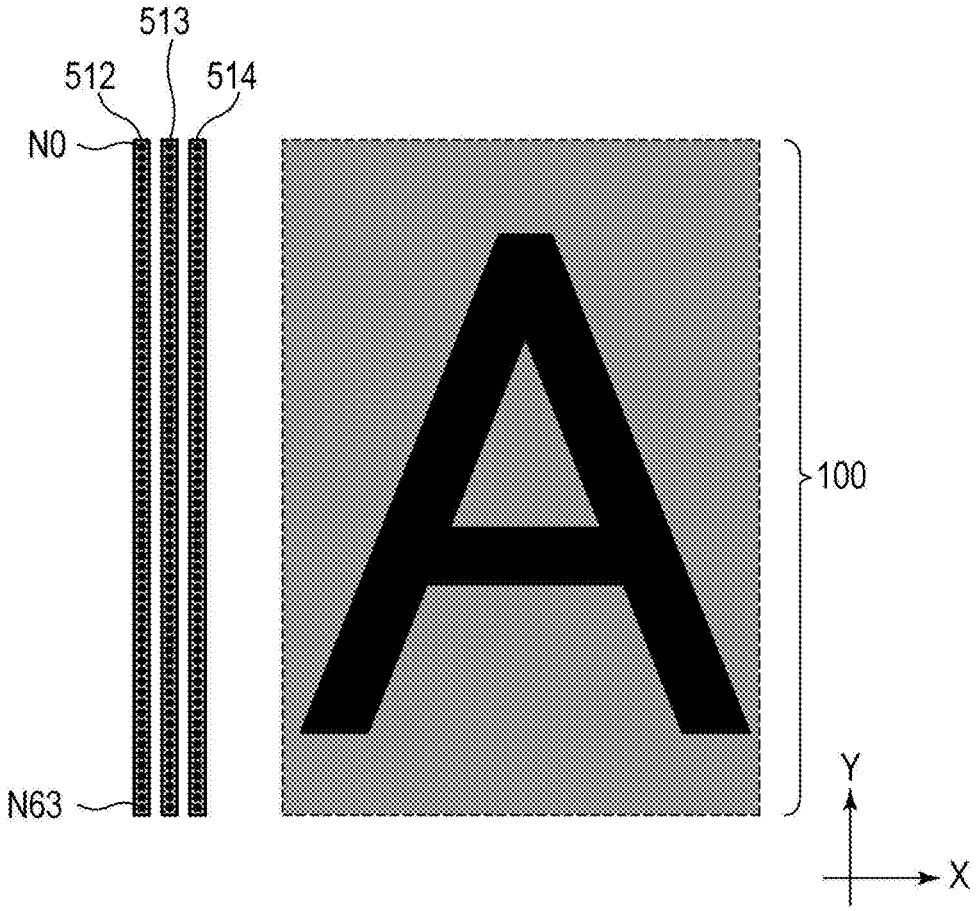
FIG. 10 is a diagram for describing a first print mode according to the exemplary embodiment.

FIG. 10 is a schematic diagram for describing, in detail, the first print mode according to the present exemplary embodiment.

With the first print mode according to the present exemplary embodiment, an image is printed in a unit area 100 of the print medium through a single scan. Specifically, in a case in which the first print mode is set in the unit area 100, the ink is ejected through the nozzles N0 to N63 of each of the nozzle array 512 for the cyan ink, the nozzle array 513 for the magenta ink, and the nozzle array 514 for the yellow ink while the print head 5 is moved in the X direction so as to print an image.

With the first print mode, the image can be completed in the unit area 100 through a single scan, and thus printing can be finished in a short period of time.

FIGS. 11A to 11D are schematic diagrams for describing, in detail, the second print mode according to the present exemplary embodiment.

Unlike the first print mode, with the second print mode according to the present exemplary embodiment, an image is printed in the unit area 100 of the print medium through four instances of the scan.

With the second print mode, the nozzles N0 to N63 of each of the nozzle array 512 for the cyan ink, the nozzle array 513 for the magenta ink, and the nozzle array 514 for the yellow ink are divided into four nozzle groups, namely, a first nozzle group that includes 16 nozzles including the nozzle N0 through the nozzle N15, a second nozzle group that includes 16 nozzles including the nozzle N16 through the nozzle N31, a third nozzle group that includes 16 nozzles including the nozzle N32 through the nozzle N47, and a fourth nozzle group that includes 16 nozzles including the nozzle N48 through the nozzle N63.

Figure 11A:
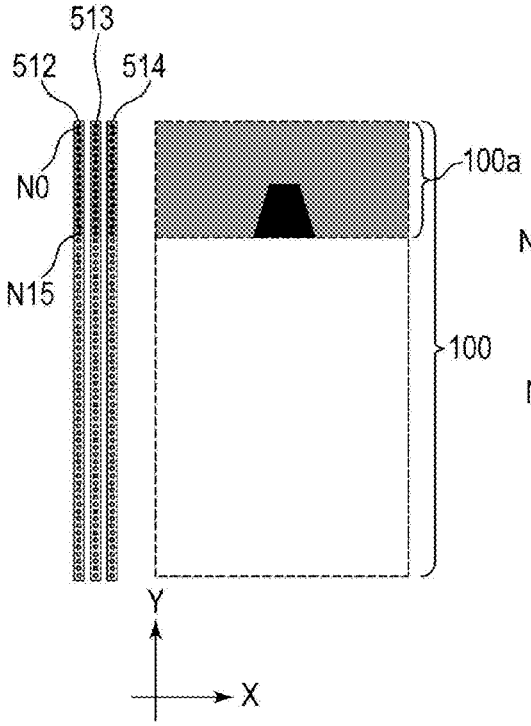
FIGS. 11A to 11D are diagrams for describing a second print mode according to the exemplary embodiment.
Figure 11B:
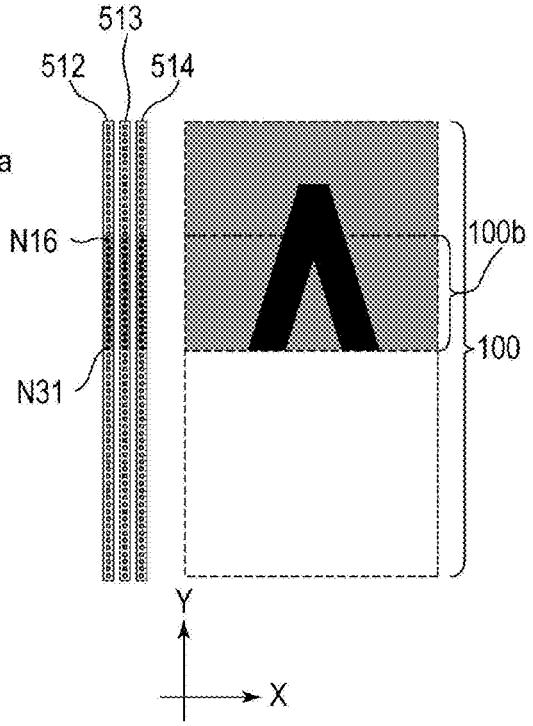
Figure 11C:
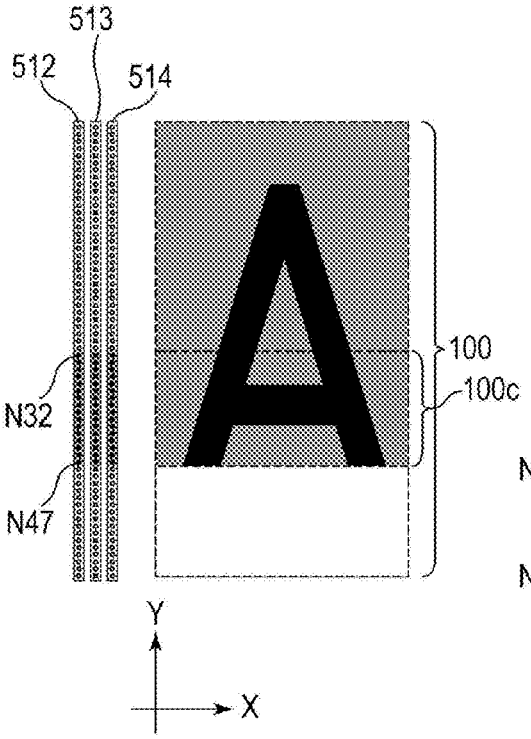
Figure 11D:
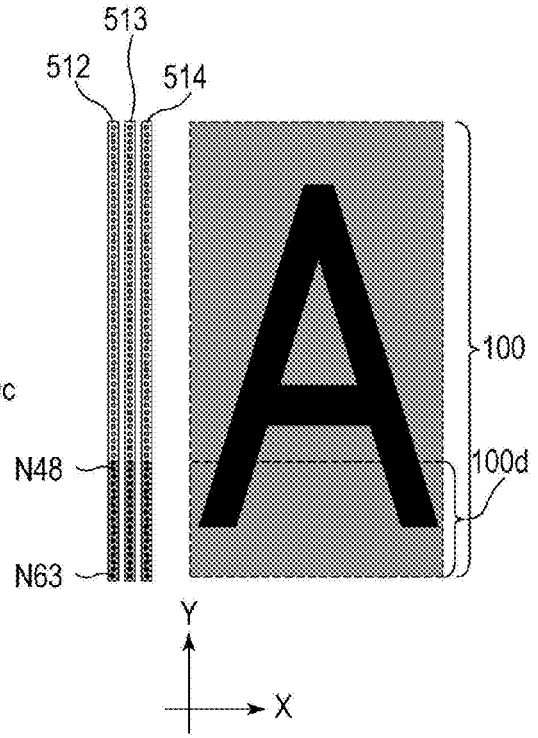

When the second print mode is set in the unit area 100, first, as illustrated in FIG. 11A, the inks are ejected from the first nozzle group while the print head 5 is moved in the X direction so as to print the image in an area 100*a* located at the upstream side end of the unit area 100 in the Y direction. Then, without the print medium being conveyed, as illustrated in FIG. 11B, the image is printed in an area 100*b* of the unit area 100 which is adjacent to the area 100*a* in the Y direction by ejecting the inks from the second nozzle group while the print head 5 is moved in the X direction. Thereafter, in a similar manner, without the print medium being conveyed, the image is printed in an area 100*c* by ejecting the inks from the third nozzle group as illustrated in FIG. 11C, and the image is printed in an area 100*d* by ejecting the inks from the fourth nozzle group as illustrated in FIG. 11D. When the printing by the fourth nozzle group is finished, it is determined that the printing on the unit area 100 has been completed, and the print medium is then conveyed in the Y direction.

With the second print mode, each of the areas 100*a*, 100*b*, 100*c*, and 100*d* is printed through a single scan. Therefore, even in a case in which an image printed through the first print mode and an image printed through the second print mode are adjacent to each other in the Y direction, color unevenness between the images, which could be generated due to a difference in the number of instances of the printing scan between areas, can be suppressed, and an image in which unevenness between areas is not noticeable can be printed.

With the second print mode, the amount of ink ejected from the print head 5 in a single scan can be reduced, and thus occurrence of the ascending air current can be suppressed. Therefore, occurrence of face wetting can be suppressed as compared with the first print mode.

Meanwhile, the scan number on a unit area is greater with the second print mode than with the first print mode, and thus the throughput decreases as compared to the first print mode. However, while the time it takes for a single scan to finish is approximately 0.3 second to 1 second, the time it takes to restore a state that allows printing to be carried out again after the surface of the nozzles is wiped once is 10 seconds to 30 seconds. Thus, the decrease in the throughput caused by the increase in the scan number is smaller than the decrease in the throughput caused by wiping the surface of the nozzles. In this manner, the second print mode makes it possible to suppress the decrease in the throughput to a certain extent.

According to the present exemplary embodiment, the image is printed in a unit area through a single scan if the cumulative value ΣNure is less than the wetting threshold value THNure, and the image is printed in a unit area through four instances of the scan when the cumulative value ΣNure has reached or exceeded the wetting threshold value THNure. In the present exemplary embodiment, the wetting threshold value THNure is set to 100, and the cumulative value ΣNure in each of the unit areas is the value indicated in FIG. 7D, as described above. Therefore, each of the first unit area (the first band) through the sixth unit area (the sixth band) is printed through a single scan as illustrated in FIG. 10, and the seventh and eighth unit areas (the seventh and eighth bands) are each printed through four instance of the scan as illustrated in FIGS. 11A to 11D.

With the configuration described above, printing is carried out through a print mode that focuses more on improving the throughput while face wetting has not occurred to such an extent that affects the ejection performance, and printing is carried out through a print mode that focuses more on suppressing a decrease in the ejection performance caused by face wetting in a case in which the ejection performance may decrease due to face wetting. Accordingly, printing can be carried out while suppressing the decrease in the throughput and suppressing the decrease in the ejection performance caused by face wetting at the same time.

Second Exemplary Embodiment

In the first exemplary embodiment, a mode in which printing is carried with the first print mode if the cumulative value ΣNure is less than the wetting threshold value THNure and with the second print mode if the cumulative value ΣNure is equal to or greater than the wetting threshold value THNure has been described.

In the meantime, in the present exemplary embodiment, a mode in which the print mode to be set is determined with the wetting coefficient XNure in each of a plurality of determination areas 30 within a unit area taken into consideration, in addition to the relationship between the cumulative value ΣNure and the wetting threshold value THNure.

It should be noted that descriptions of configurations that are identical to those of the first exemplary embodiment described above will be omitted.

Figure 12:
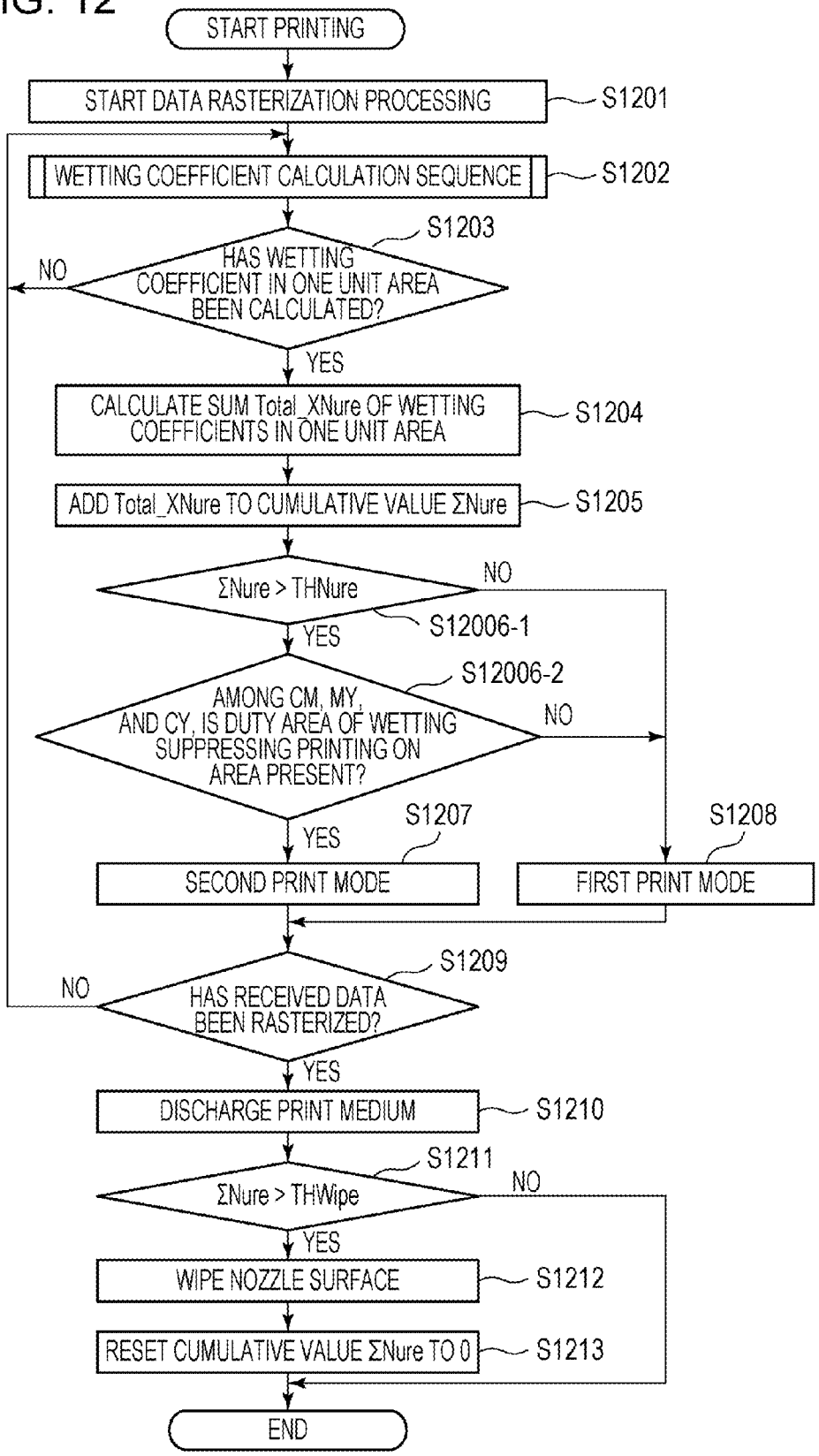
FIG. 12 is a flowchart for describing a printing method according to a second exemplary embodiment.

FIG. 12 is a flowchart for describing a printing method according to the present exemplary embodiment.

In the present exemplary embodiment, in S1206-1, processing similar to that in S906 of the first exemplary embodiment is carried out. If the cumulative value ΣNure obtained when printing is to be carried out in a single unit area is less than the wetting threshold value THNure, the processing proceeds to S1208, and printing is carried out through the first print mode through which an image is completed in a unit area through a single scan. Meanwhile, if the cumulative value ΣNure is equal to or greater than the wetting threshold value THNure, the processing proceeds to S1206-2.

In S1206-2, it is determined whether or not there is a determination area 30, among a plurality of determination areas 30 forming the single unit area, for which the wetting coefficient XNure is greater than a second wetting threshold value THNure2. Here, the second wetting threshold value THNure2 is a value that indicates how likely face wetting is to occur, and, as in the wetting threshold value THNure, can be set to an appropriate value in accordance with the physical properties of the nozzles and the inks. In the present exemplary embodiment, it is estimated that face wetting occurs if there is at least one determination area 30 for which the wetting coefficient XNure is equal to or greater than 1, and the second wetting threshold value THNure2 is thus set to 1.

If the cumulative value ΣNure is equal to or greater than the wetting threshold value THNure and if there is no determination area 30 within the single unit area for which the wetting coefficient XNure is equal to or greater than the second wetting threshold value THNure2, the processing proceeds to S1208. In S1208, the first print mode is set, and printing is carried out accordingly. Meanwhile, if the cumulative value ΣNure is equal to or greater than the wetting threshold value THNure and if there is at least one determination area 30 for which the wetting coefficient XNure is equal to or greater than the second wetting threshold value THNure2, the processing proceeds to S1207. In S1207, the second print mode through which the image is completed in a unit area through four instances of the scan is set, and printing is carried out accordingly.

In other words, in the present exemplary embodiment, the wetting threshold value THNure is set to 100, and the second wetting threshold value THNure2 is set to 1. The cumulative value ΣNure in each of the unit areas and the wetting coefficient XNure of the plurality of determination areas 30 forming each of the unit areas take the values indicated in FIG. 7D, as described above.

Therefore, the cumulative value ΣNure is less than 100 in the unit areas including the first unit area (the first band) through the sixth unit area (the sixth band); thus, the first print mode is set, and printing is carried out in each of the stated unit areas through a single scan as illustrated in FIG. 10.

In the seventh unit area (the seventh band), the cumulative value ΣNure is equal to or greater than 100, and the wetting coefficient XNure is equal to or greater than 1 in the determination areas 30 of the third column and the fourth column; therefore, it is determined that face wetting is likely to occur. Thus, the second print mode is set in S1207, and the printing is carried out through four instances of the scan as illustrated in FIGS. 11A to 11D.

In addition, in the eighth unit area (the eighth band), the cumulative value ΣNure is equal to or greater than 100, and the wetting coefficient XNure is equal to or greater than 0 in each of the determination areas 30. Therefore, although face wetting has occurred at the surface of the print head 5 to a certain extent, it is determined that face wetting does not progress further when the eighth unit area is printed. Thus, the first print mode is set in S1208, and the printing is carried out through a single scan as illustrated in FIG. 10.

Thereafter, processes in S1209 to S1213 are the same as those in S909 to S913 described with reference to FIG. 9 in the first exemplary embodiment.

According to the configuration described above, even in a case in which face wetting has already occurred to a certain extent, if it is not likely that face wetting progresses further through a subsequent instance of the scan, printing is carried out through a print mode with a smaller scan number. Through this, the decrease in the throughput can be further suppressed while suppressing the deterioration of the ejection performance caused by face wetting.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although an assumption in each of the exemplary embodiments described above is that a primary factor for causing the ascending air current leading to the occurrence of face wetting to occur is ejection of inks from two nozzle arrays among the three nozzle arrays for ejecting the chromatic color inks and a mode in which the wetting coefficient is calculated on the basis of the ejection amount from the two nozzle arrays has been described, a different mode can be employed. The primary factor for causing the ascending air current to occur varies depending on various factors such as the placement of the nozzle arrays and the physical properties of the inks. For example, the wetting coefficient may be calculated on the basis of an amount of ink ejected from only one nozzle array that has the largest ink ejection amount among the three nozzle arrays for ejecting the chromatic color inks, or the wetting coefficient may be calculated on the basis of the sum of the amounts of inks ejected from the three nozzle arrays. In addition, although an amount of ink ejected from the nozzle array for the black ink is considered to have little influence on the occurrence of the ascending air current and is thus not used to calculate the wetting coefficient, the amount of ink ejected from the nozzle array for the black ink can also be used.

In addition, an assumption in each of the exemplary embodiments described above is that the ejection of ink from a pair of the nozzle array 512 for the cyan ink disposed at one end in the X direction and the nozzle array 514 for the yellow ink disposed at the other end in the X direction among the three nozzle arrays for ejecting the chromatic color inks has the greatest influence on the occurrence of the ascending air current. Therefore, a plurality of tables among which a table corresponding to the printing duties of the cyan ink and the yellow ink is the most dominant have been used to calculate the wetting coefficient as illustrated in FIGS. 8A to 8C. Alternatively, such a mode as described below can also be employed. For example, such tables may be used that the wetting threshold value XNure for each printing duty is identical among a table corresponding to the printing duties of the cyan ink and the yellow ink, a table corresponding to the printing duties of the cyan ink and the magenta ink, and a table corresponding to the printing duties of the magenta ink and the yellow ink.

In addition, in each of the exemplary embodiments described above, a print mode through which an image is completed in a unit area through a single scan is employed as the first print mode, and a print mode through which an image is completed in a unit area through four instances of the scan is employed as the second print mode. Alternatively, a different mode can be employed. The effect described in each of the exemplary embodiments can be obtained as long as the second print mode is such a print mode that the permissible amount of ink to be ejected in a single scan is set to an amount with which the occurrence of the ascending air current can be suppressed as compared to the first print mode and that an image is printed through a larger number of instances of the scan as compared to the first print mode. For example, a print mode through which an image is completed in a unit area through two instances of the scan may be employed as the first print mode, and a print mode through which an image is completed in a unit area through eight instances of the scan may be employed as the second print mode.

In addition, although a mode in which, with the second print mode, an image is printed in such a manner that each of the nozzle arrays is divided into a plurality of nozzle groups so as to limit the number of nozzles that eject ink in a single scan and the inks are ejected successively through the nozzle groups without conveying the print medium between successive instances of the scan has been employed in each of the exemplary embodiments described above, a different mode can be employed. For example, an effect similar to the effect described in each of the exemplary embodiments can be obtained even with a mode in which while all of the nozzles, namely the nozzle NO to the nozzle N63, are used in a single scan, a scan in which ink is ejected to only one of the four adjacent columns within a unit area is carried out four times on the unit area.

In addition, although a mode in which the distance between the print medium and the surface of the nozzles stays constant and the wetting coefficient is calculated by using a table of a single pattern for each of the inks has been described in each of the exemplary embodiments described above, a different mode can be employed. For example, when the distance between the print medium and the surface of the nozzles varies, the degree of occurrence of the ascending air current or the distance in which an ink droplet rises by being taken into the ascending air current varies as well. Thus, it is preferable to calculate the wetting coefficient by using a plurality of tables that differ in accordance with the distance between the print medium and the surface of the nozzles.

According to the printing apparatus and the printing method of an example of the present invention, printing can be carried out while the deterioration of the printing quality caused by face wetting is suppressed and the throughput is improved at the same time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-149874, filed Jul. 18, 2013, which is hereby incorporated by reference herein in its entirety.

What is claimed is:

1. A printing apparatus for printing an image on a plurality of unit areas of a print medium by ejecting ink from a print head having at least one nozzle array in which a plurality of nozzles for ejecting ink are arrayed in an array direction while scanning the print medium with the print head at plural times in a scan direction crossing the array direction, each of the plurality of unit areas having a length in the array direction corresponding to a length of the nozzle array in the array direction, the printing apparatus comprising:

a wiping unit configured to wipe a surface of a nozzle member provided with the plurality of nozzles;

a first obtaining unit configured to obtain first information regarding a sum of ink ejection amounts for scans performed between a scan immediately after the surface of the nozzle member is wiped by the wiping unit and a predetermined scan in which ink is ejected onto a predetermined unit area which is one of the unit areas;

a selecting unit configured to select either a first print mode or a second print mode with respect to each of the plurality of unit areas based on the first information obtained by the first obtaining unit, the first print mode being a print mode for printing an image on the unit area by scanning a first number of times, the second print mode being a print mode for printing an image on the unit area by scanning a second number of times while a number of ink ejections in each scan is restricted, and the second number of times being greater than the first number of times; and a controlling unit configured to control printing on each of the plurality of unit areas according to either the first print mode or the second print mode selected by the selecting unit with respect to each of the plurality of unit areas, wherein the selecting unit selects, as a print mode corresponding to the predetermined unit area, (i) the first print mode in a case in which a value indicated by the first information obtained by the first obtaining unit is a first value, and (ii) the second print mode in a case in which the value indicated by the first information obtained by the first obtaining unit is a second value that is greater than the first value.

2. The printing apparatus according to claim 1, wherein the wiping unit wipes the surface of the nozzle member in a case in which the value indicated by the first information obtained by the first obtaining unit is a fifth value and does not wipe the surface of the nozzle member in a case in which the value indicated by the first information obtained by the first obtaining unit is a sixth value that is less than the fifth value.

3. The printing apparatus according to claim 2, wherein the wiping unit determines whether or not to wipe the surface of the nozzle member when printing of an image on a single sheet of the print medium is completed.

4. The printing apparatus according to claim 2, further comprising:

a storing unit configured to store the first information obtained by the first obtaining unit; and an initializing unit configured to initialize the first information stored in the storing unit upon the wiping unit wiping the surface of the nozzle member.

5. The printing apparatus according to claim 1, wherein the first print mode is a print mode in which an image is printed in the unit area with one time of scanning.

6. The printing apparatus according to claim 1, further comprising:

a second obtaining unit configured to obtain second information regarding an amount of ink to be ejected onto the predetermined unit area in the predetermined scan, wherein the selecting unit selects, as a print mode corresponding to the predetermined unit area, (ii-1) the first print mode in a case in which the value indicated by the first information obtained by the first obtaining unit is the second value and a value indicated by the second information obtained by the second obtaining unit is a third value, and (ii-2) the second print mode in a case in which the value indicated by the first information obtained by the first obtaining unit is the second value and the value indicated by the second information obtained by the second obtaining unit is a fourth value that is greater than the third value.

* * * * *